United States Patent [19]

Ohbayashi et al.

[11] 4,374,922

[45] Feb. 22, 1983

[54] METHOD FOR THE FORMATION OF A DYE IMAGE

[75] Inventors: Keiji Ohbayashi, Sagamihara; Akihiko Miyamoto, Odawara; Masaru Iwagaki, Odawara; Makoto Kajiwara, Odawara, all of Japan

[73] Assignee: Konishiroku Photo Industry Co., Ltd., Tokyo, Japan

[21] Appl. No.: 282,258

[22] Filed: Jul. 10, 1981

[30] Foreign Application Priority Data

Jul. 11, 1980 [JP] Japan ..... 55-93909

[51] Int. Cl.[3] ..... G03C 7/00

[52] U.S. Cl. ..... 430/383; 430/384; 430/385; 430/393; 430/405; 430/448

[58] Field of Search ..... 430/383, 405, 448, 505, 430/552, 553, 566, 393, 384, 385

[56] References Cited

U.S. PATENT DOCUMENTS

| | | | |
|---|---|---|---|
| 2,478,400 | 8/1949 | Jelley et al. | 430/552 |
| 2,895,826 | 7/1959 | Salminen et al. | 430/384 |
| 3,342,597 | 9/1967 | Harnish et al. | 430/376 |
| 3,719,492 | 3/1973 | Barr et al. | 430/376 |
| 4,239,851 | 12/1980 | Aoki et al. | 430/552 |
| 4,299,914 | 11/1981 | Fujimatsu et al. | 430/552 |
| 4,304,844 | 12/1981 | Fujimatsu et al. | 430/552 |

*Primary Examiner*—J. Travis Brown

*Attorney, Agent, or Firm*—Finnegan, Henderson, Farabow, Garrett & Dunner

[57] ABSTRACT

A method for the formation of a dye image. A silver halide color photographic light-sensitive material, having a support, component layers which are provided on the support and which have a swelling degree below 250 in the alkaline bath and components including an aromatic primary amine color developing agent or a precursor thereof, a nondiffusing yellow coupler, a nondiffusing magenta coupler and a nondiffusing phenolic cyan coupler having a substituted or unsubstituted acylamino group at the second and fifth positions thereof, is color developed in an alkaline bath. The material is then processed in a bleach-fixing bath.

6 Claims, No Drawings

METHOD FOR THE FORMATION OF A DYE IMAGE

The present invention relates to a method for the formation of a dye image wherein a silver halide color photographic light-sensitive material containing an aromatic primary amine color developing agent or the precursor thereof is processed in an alkaline bath to form a dye image which is then processed in a bleaching bath or a bleach-fixing bath, and more particularly relates to a method for rapidly obtaining a dye image with not only sufficiently maintaining the strength of the layers of the light-sensitive material but also preventing the formation of a leuco compound of the cyan dye during the processing.

Normally, an imagewise exposed silver halide color photographic light-sensitive material is immersed in alkaline solution comprising an aromatic primary amine color developing agent (color developing agent) thereby to form a dye image, which is then processed in bleaching and fixing baths or in a bleach-fixing bath to be desilvered, whereby an imagewise dye image only can be obtained. Alternatively, there has been made also such an attempt as to incorporate an aromatic primary amine color developing agent or the precursor thereof into a silver halide color photographic light-sensitive material. In this case, in order to obtain a color dye image, the silver halide color photographic light-sensitive material comprising the color developing agent or the precursor thereof is imagewise exposed, and then is processed in an alkaline bath to form a color image, and thereafter is desilvered. Such manners as obtaining a dye image by the processing in an alkaline bath of a silver halide color photographic light-sensitive material comprising a color developing agent or the precursor thereof have been disclosed in such publications as, for example, in U.S. Pat. No. 3,342,597 and No. 3,719,492, Research Disclosure No. 14850, No. 13924 and No. 12146, Japanese Pat. Publication Open to Public Inspection (hereinafter referred to aas Japanese Pat. O.P.I. Publication) No. 111729/1978 and No. 135628/1978.

In the method for the formation of a dye image wherein a color developing agent or the precursor thereof is incorporated into a silver halide color photographic light-sensitive material which is processed in an alkaline bath thereby to effect a color development, as the bath for initially forming a dye image an alkaline solution not substantially comprising a color developing agent may be employed. This thing not only has such an advantage that the preparation of the bath can be made without touching the color developing agent that irritates the skin but also permits curtailing the processing period of time itself. In an ordinary color processing, although such a curtailment may be made by raising the processing temperature or pH of the solution, when the silver halide color photographic light-sensitive material is successively processed over a long period in an automatic processor the color developing agent is rapidly decomposed, bringing about a large change in the concentration of the color developing agent which causes the deterioration of the processing efficiency, thus becoming unable to continue the substantial rapid processing even if raising the temperature or the pH, whereas in the case of the processing in the alkaline bath without a color developing agent such a problem hardly arises. Accordingly, the alkaline bath substantially not comprising any color developing agent, which processes silver halide color photographic light-sensitive material comprising a color developing agent is capable of being maintained at a higher temperature and higher pH over a longer period of time than the conventional color developing agent.

The "alkaline bath substantially not comprising a color developing agent" stated above means such as alkaline bath that when a silver halide color photographic light-sensitive material comprising a color developing agent is processed in said alkaline bath, the said bath becomes comprising the color developing agent in such a concentration as to be dependent on the processed amount of light-sensitive materials, but in the case of processing the imagewise exposed silver halide color photographic light-sensitive material comprising a color developing agent in both the color developing agent in said concentration-comprising alkaline bath and the alkaline bath not comprising such color developing agent at all, the two baths give the substantially same sensitometry.

On the other hand, to short the overall processing time, it is not sufficient to make only the color development, the initial stage of the whole processing, rapid by raising the temperature and pH of the alkaline bath but the subsequent desilvering process, washing process and drying process must also be shortened. Particularly for the desilvering, to short the overall processing time, it is preferable to use a single bleach-fixing bath rather than the application of the separated bleaching bath and fixing bath.

Incidentally, in order to adapt the alkaline bath for a rapid processing, it is necessary to largely increase the developing rate of the bath by way of raising the temperature or the pH, but at this time, the developing reaction is required to be substantially completed before the aromatic primary amine color developing agent or the precursor thereof comprising in the silver halide color photographic light-sensitive material is all dissolved out therefrom into the bath. Therefore, the pH and the temperature of the alkaline bath are needed to be raised to such an extent that the developing reaction can fully go ahead of the dissolving of the diffusing color developing agent or the precursor thereof into the bath. Because of such characteristics that the alkaline bath is used at a high temperature and high pH, the binder, such as gelatin, composing the silver halide color photographic light-sensitive material to be processed by the bath must be as much strengthened; otherwise the layers of the material would become dissolved into the bath, or the surface thereof would get scratched, thus resulting in the deterioration of its value as a commodity. Consequently, in order to perform an alkaline processing with high temperature and/or high pH, the component layers of the silver halide color photographic light-sensitive material must be given a sufficient strength against the alkaline solution in such ways as the addition to the layers of a selected kind or quantity of a hardener or of a hardening accelerating agent, or the temporal storage of the light-sensitive material under the condition of a higher humidity at a higher temperature after the coating thereof.

We have found, however, that when the layers were strengthened in such manners, an unexpected important problem occurred in the bleaching bath or particularly in the bleach-fixing bath following the alkaline bath; that is, when a silver halide color photographic light-sensitive material having sufficiently strengthened layers was processed in the alkaline bath, in the subsequent processing in the bleaching bath or particularly in the bleach-fixing bath, the cyan dye was converted into a colorless leuco-cyan dye, so that a satisfactory cyan color density was not produced. On this occasion, if a sufficient time is spent for the bleach or the bleach-fixing, such a problem may have been reduced, but the purpose of the alkaline processing aiming at a rapid processing may not be accomplished. The problem of the formation of a leuco-cyan dye is dependent largely on the strength of the gelatin layer; even a slight increase of the strength causes a considerable problem. Therefore, in the case of processing successively in the alkaline bath such a silver halide color photographic light-sensitive material comprising a color developing agent or the precursor thereof whose layer strength has to be sufficiently maintained in the alkaline bath because in a bleaching bath or in a bleach-fixing bath whose pH is in the proximity of neutral the swelling of the gelatin layers in restrained more substantially than in the alkaline bath, the foregoing problem has been found out to be far more serious than conventionally observed problems of the formation of leuco-cyan dyes.

The problem has heretofore been not at all taken into account in the method for the formation of dye images wherein a silver halide color photographic light-sensitive material comprising an aromatic primary amine color developing agent is color developed by being processed in an alkaline bath and then is processed in a bleaching bath or particularly a bleach-fixing bath.

It is an object of the present invention to provide a method for the formation of a dye image capable of giving rapidly a satisfactory dye image through the procedure comprising maintaining a sufficiently secure layer strength at the time of the processing in the alkaline bath of the silver halide color photographic light-sensitive material comprising an aromatic primary amine color developing agent or the precursor thereof and preventing the formation of a leuco-cyan dye in the bleaching bath or particularly the bleach-fixing bath.

Other objects of the present invention will be clarified in the following descriptions of the present invention.

The above-described object of the present invention may be accomplished in such a way that in the method for the formation of a dye image wherein a silver halide color photographic light-sensitive material comprising an aromatic primary amine color developing agent or an aromatic primary amine color developing agent precursor, nondiffusing yellow coupler, nondiffusing magneta coupler and nondiffusing cyan coupler is color developed by being processed in an alkaline bath, and thereafter is processed in a bleaching bath or particularly a bleach-fixing bath, the improvement characterized in that said cyan coupler is a phenolic cyan coupler having a substituted or unsubstituted acylamino group in the second and fifth positions thereof.

As such phenolic cyan couplers having a substituted or unsubstituted acylamino group in the second and fifth positions thereof, there may be used known phenolic cyan couplers having a substituted or unsubstituted acylamino group in the second and fifth positions thereof; especially there may be preferably used such ones that are described in U.S. Pat. No. 2,895,826, Japanese O.P.I. Publication No. 109630/1978, No. 29235/1981, No. 163537/1980, Japanese Pat. Application No. 2305/1980 and No. 2755/1980, and Research Disclosure No. 19424.

Such cyan couplers have the following formulas:

Formula [I]

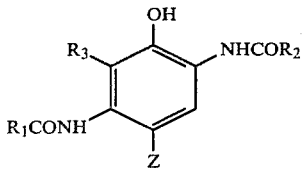

Formula [II]

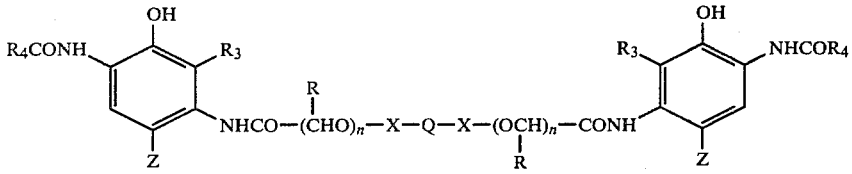

Wherein (in both formulas [I] and [II]) R represents hydrogen or an alkyl group having from 1 to 20 carbon atoms, $R_1$ and $R_2$ independently represent a substituted or unsubstituted alkyl group, aryl group, heterocyclic group or $$-\underset{\underset{R'}{|}}{(CHO)}_m-X'-R^5,$$

$R_3$ represents hydrogen, chlorine or bromine, $R_4$ represents an alkyl group, aryl group or heterocyclic group, X represents an alkylene group or arylene group, Q represents $$-\underset{\underset{A}{|}}{N}-SO_2-(R'')_{m''}-(C'y)-(Y)l-(C''y)k-(R''')_{m'''}-SO_2-\underset{\underset{A}{|}}{N}-$$

or $$-SO_2-\underset{\underset{A}{|}}{N}-(R'')_{m''}-(C'y)-(Y)l-(C''y)k-(R''')_{m'''}-\underset{\underset{A}{|}}{N}-SO_2-,$$

Z represents hydrogen or a group which is, on coupling reaction of the coupler with an oxidized color developing agent, capable of being split off (hereinafter referred to as "split-off group"), and n represents an integer of zero or 1; and R' represents hydrogen or an alkyl group having from 1 to 20 carbon atoms, X' is an alkylene group or arylene group, $R_5$ represents hydrogen, alkylsulfoneamide group, arylsulfoneamide group, alkylsulfamoyl group, arylsulfamoyl group, alkyloxycarbonyl group, alkyloxysulfonyl group, aryloxysulfonyl group, alkylsulfonyloxy group, arylsulfonyloxy group, $$-Cy-(R'')_{m'}-SO_2-\underset{\underset{A}{|}}{N}-,\ -Cy-(R'')_{m'}-\underset{\underset{A}{|}}{N}-SO_2-,$$

or either one of the monovalent groups having at least one sulfone group, Cy, Cy' and Cy'' represent cyclic groups comprising an aliphatic cyclic group, aromatic cyclic group, or heterocyclic group, R'' and R''' each represents an alkyl group, Y represents a divalent organic group which connects C'y with C''y, A represents hydrogen or a monovalent organic group, and k,l,m,m',m''and m''' independently represent an integer of zero or 1 provided that when m'=0, the Cy represents an aliphatic cyclic or heterocyclic group.

The above Formulas [I] and [II] are described in further detail below: The alkyl groups represented by R and R' in Formulas [I] and [II] may be of either straight chain or branched chain such as methyl, ethyl, isopropyl, butyl, tert-butyl, n-decyl, n-dodecyl. The alkyl group represented by $R_1$, $R_2$ and $R_4$ are ones having from 1 to 20 carbon atoms and may be of either straight chain or branched chain such as methyl, ethyl, isopropyl, n-butyl, tert-butyl, n-dodecyl and n-pentadecyl. And there are phenyl, naphthalene, and the like as aryl groups, and furan and the like as heterocyclic groups. These alkyl, aryl, and heterocyclic groups may have such substituents as chlorine, bromine, alkyl, nitro, hydroxyl, carboxyl, amino, sulfo, cyano, alkoxy, aryloxy, arylthio, acylamino, carbamoyl, ester, acyl, acyloxy, sulfoneamide, sulfamoyl, sulfonyl, sulfoxy, oxylsulfonyl groups.

Further, the alkylene groups in X and X' include, e.g., methylene, ethylene and butylene having from 1 to 4 carbon atoms, and the arylene groups include phenylene, naphthylene, and the like. The alkylene or arylene group may be substituted by such as alkyl (such as methyl, ethyl, isobutyl, dodecyl, tert-acyl, cyclohexyl, pentadecyl and the like), alkenyl (such as allyl), aryl, heterocyclic residues, chlorine, bromine, nitro, hydroxy, carboxy, amino, sulfo, alkoxy, aryloxy, arylthio, acylamino, carbamoyl, ester, acyl, acyloxy, sulfoneamide, sulfamoyl, sulfonyl, morpholino groups and the like.

The alkyl comprising in the alkylsulfoneamide, alkylsulfamoyl, alkyloxycarbonyl, alkyloxysulfonyl, alkylsulfonyl groups in the foregoing $R_5$ may be either of straight chain or of branched chain having from 1 to 20 carbon atoms, which includes, e.g., methyl, ethyl, isopropyl, n-butyl, hexyl, n-dodecyl, and tetra-decyl groups while the aryl comprising in the arylsulfoneamide, arylsulfamoyl, aryloxysulfonyl, arylsulfonyloxy groups includes phenyl or naphthalene groups, which may be subtituted by such substituents as, e.g., hydroxy, acyloxy, carboxyl, amino, substituted amino, sulfo, alkyl, arylalkoxy, aryloxy, arylthio, acylamino, carbamoyl, acyloxy, acyl, sulfoneamide, sulfamoyl, sulfonyl, morpholino groups.

The Z shown in Formulas [I] and [II] represents hydrogen or a split-off groups. Examples of the latter are arloxy, carbamoyloxy, carbonylmethoxy, acyloxy, alkyloxy, sulfoneamide, succinimede groups the active cites of which are directly connected with such halogen atoms (as chlorine, bromine, fluorine), oxygen or nitrogen atom, and more concrete, useful examples of which are described in U.S. Pat. No. 3,471,563, Japanese Patent O.P.I. Publication No. 37425/1972, Japanese Pat. Examined Publication No. 36894/1973, Japanese Pat. O.P.I. Publication No. 10135/1975, No. 117422/1975, No. 130441/1975, No. 108841/1976, 120334/1975, No. 18315/1977, No. 52423/1978 and No. 105226/1978.

Further, the foregoing Cy, C'y and C''y represent cyclic groups whose examples are aliphatic cyclic groups such as cyclopropyl, cyclobutyl, cyclopentyl, cyclohexyl, cyclooctyl, cyclohexenyl, cyclohexine, such aliphatic cyclic groups as phenyl, naphthyl and the like, heterocyclic groups as imidazolidinyl, morphonyl, piperazinyl, pyridyl, monoryl and the like.

As the substituents that may be introduced to these cyclic groups there may be cited, e.g., chlorine, bromine, nitro, hydroxy, carboxyl, amino, substituted amino, sulfo, alkyl, alkenyl, aryl, heterocyclic, alkoxy, aryloxy, arylthio, arylazo, acylamino, carbamoyl, ester, acyl, acyloxy, sulfoneamide, sulfamoyl, sulfonyl, morpholino groups.

And R'' and R''' represent alkyl groups, and may be either saturated or unsaturated, and also may be either of straight chain or of branched chain, which include, e.g., methylene, ethylene, trimethylene, propylene, dodecamethylene, propenylene groups.

Actual phenolic cyan coupler compounds that have a substituted or unsubstituted acylamino group in the second and fifth position thereof applicable to the present invention (hereinafter referred to as the phenolic cyan coupler of the present invention) may be synthesized in accordance with the descriptions of the foregoing U.S. Pat. No. 2,895,826, Japanese Patent O.P.I. Publication No. 109630/1978, No. 29235/1981, No. 163537/1980, Japanese patent application No. 2305/1980 and No. 2755/1980. Typical examples preferably applicable to the present invention are given below:

Exemplified Coupler-1

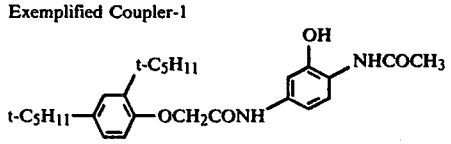

Exemplified Coupler-2

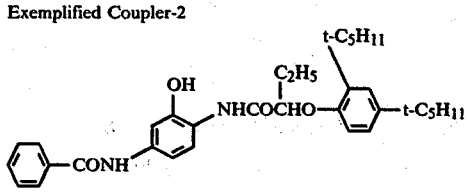

Exemplified Coupler-3

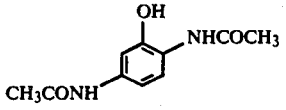

Exemplified Coupler-4

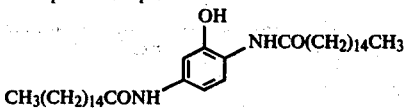

Exemplified Coupler-5

Exemplified Coupler-6

-continued
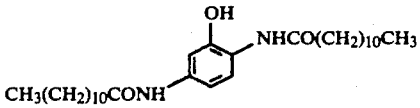
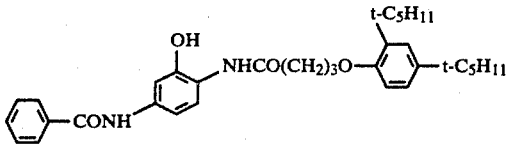
Exemplified Coupler-7
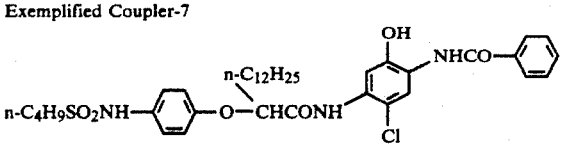
Exemplified Coupler-8
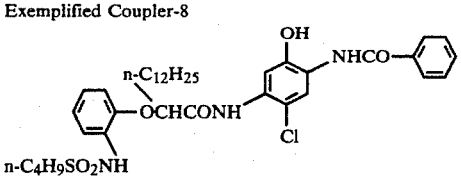
Exemplified Coupler-9
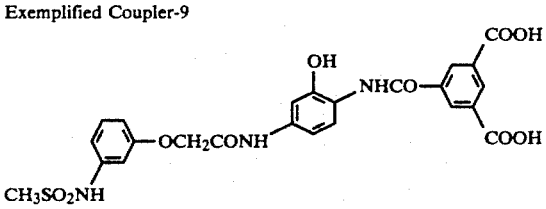
Exemplified Coupler-10
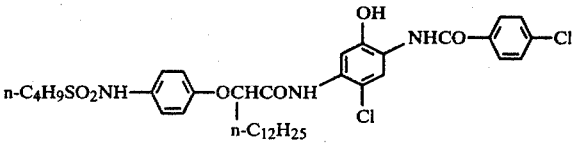
Exemplied Coupler-11
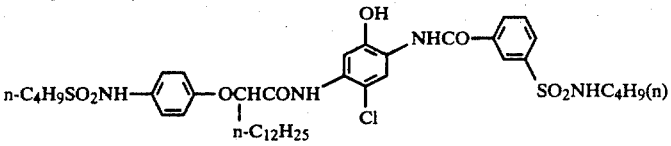
Exemplified Coupler-12
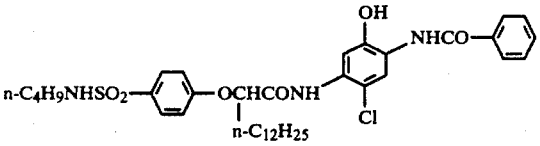
Exemplified Coupler-13
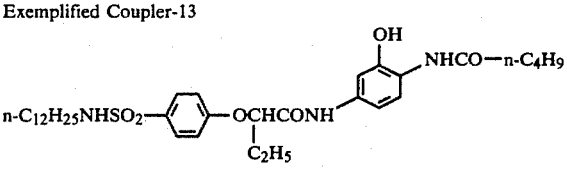
Exemplified Coupler-14
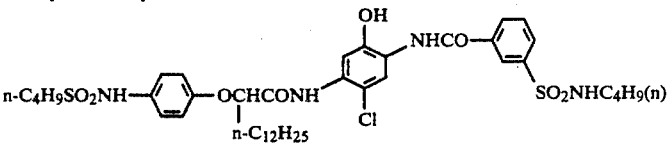
Exemplified Coupler-15
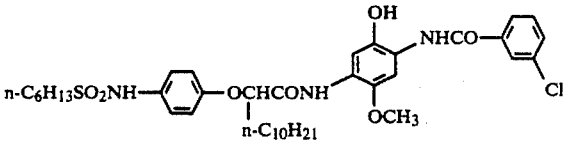
Exemplified Coupler-16
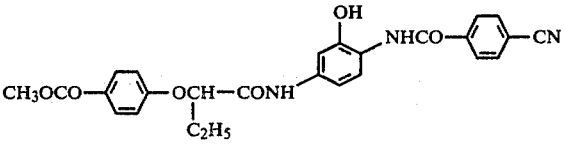
Exemplified Coupler-17
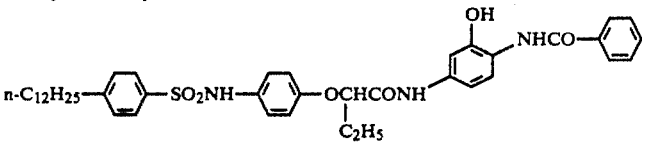
Exemplified Coupler-18
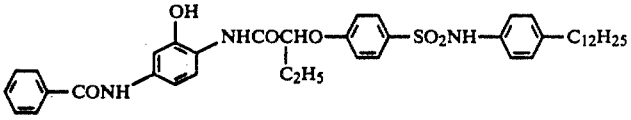
Exemplified Coupler-19

-continued
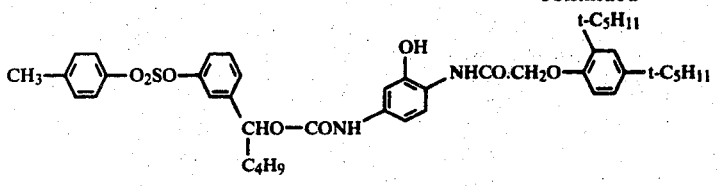
Exemplified Coupler-20
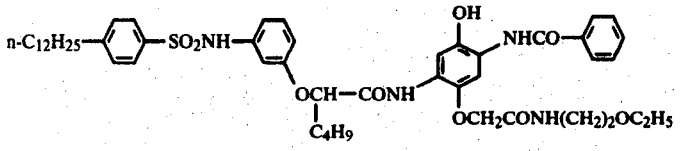
Exemplified Coupler-21
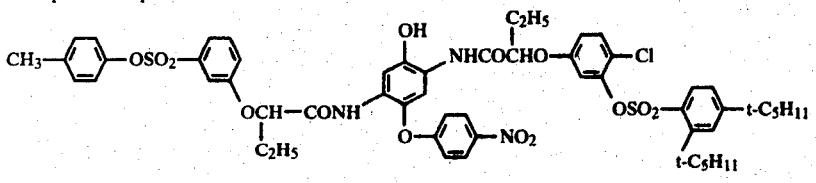
Exemplified Coupler-22
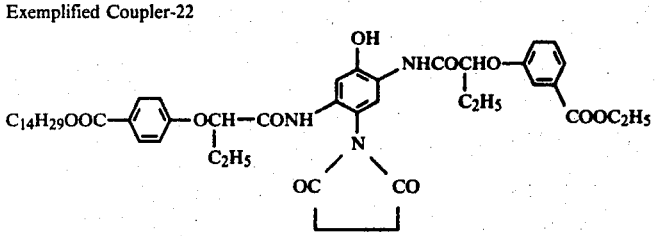
Exemplified Coupler-23
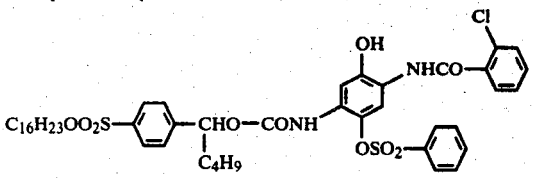
Exemplified Coupler-24
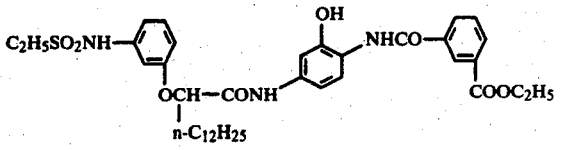
Exemplified Coupler-25
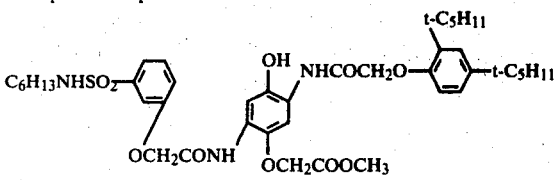
Exemplified Coupler-26
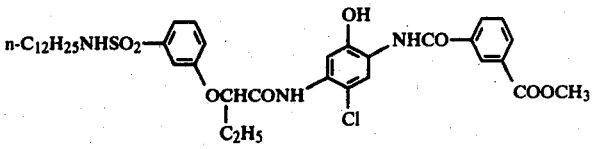
Exemplified Coupler-27
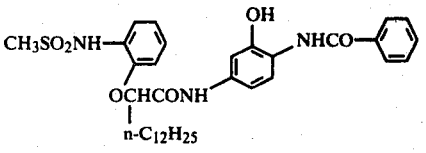
Exemplified Coupler-28
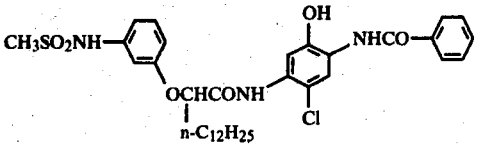
Exemplified Coupler-29
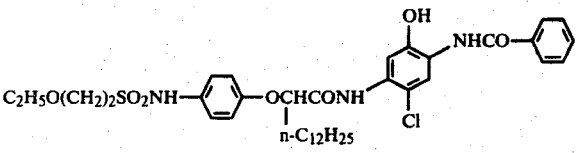
Exemplified Coupler-30

-continued
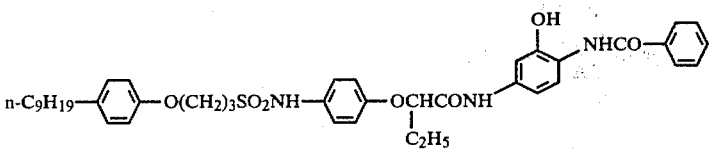
Exemplified Coupler-31
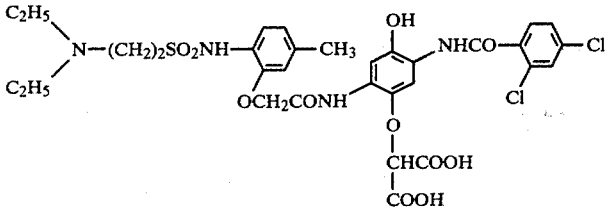
Exemplified Coupler-32
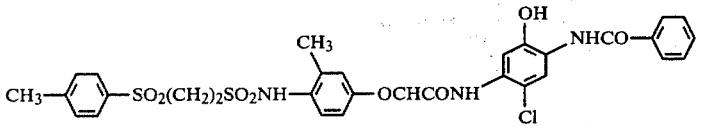
Exemplified Coupler-33
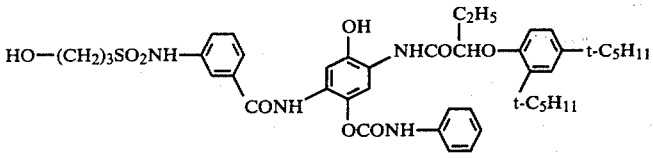
Exemplified Coupler-34
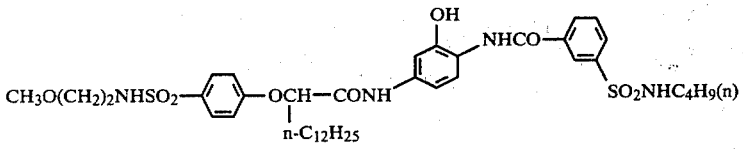
Exemplified Coupler-35
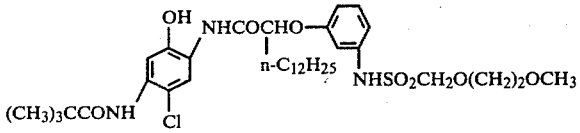
Exemplified Coupler-36
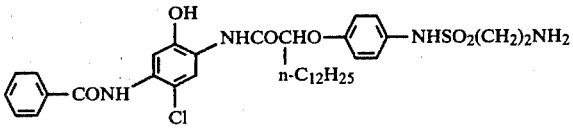
Exemplified Coupler-37
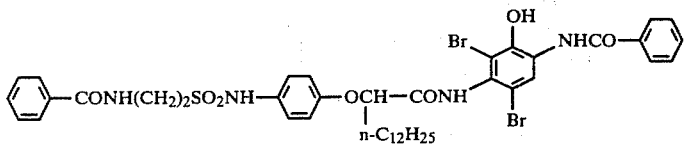
Exemplified Coupler-38
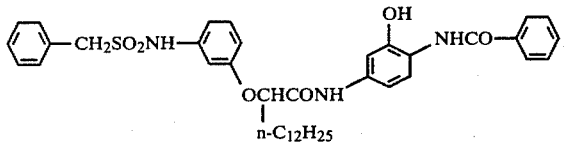
Exemplified Coupler-39
Exemplified Coupler-40

-continued

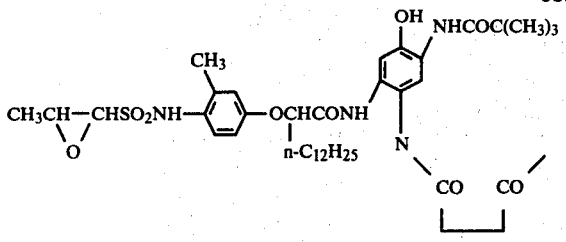

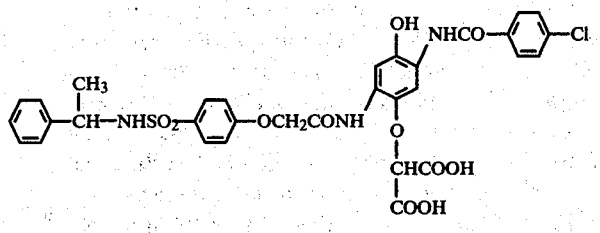

Exemplified Coupler-41

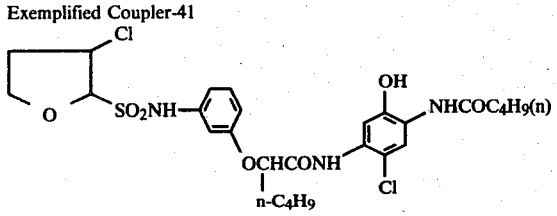

Exemplified Coupler-42

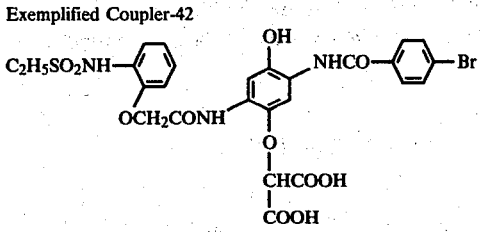

Exemplified Coupler-43

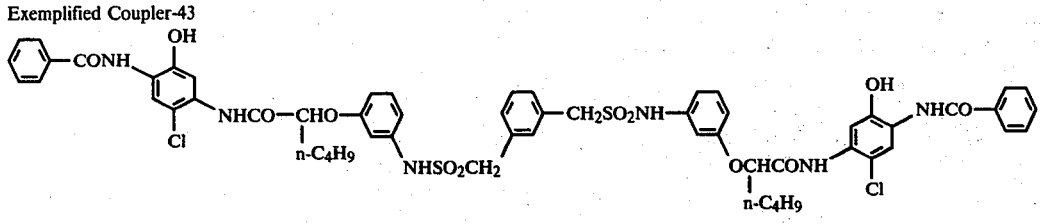

Exemplified Coupler-44

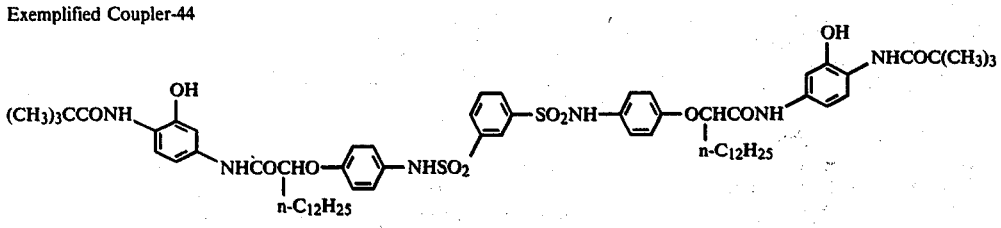

These phenolic cyan couplers of the present invention may at need be emulsified with such a high boiling organic solvent as dibutyl phthalate, dioctyl phthalate, tricresyl phosphate and the like and dispersed into a silver halide color photographic light-sensitive material.

The adding quantity of the phenolic cyan coupler of the present invention should be normally from 0.5 to 20 mg/100 $cm^2$, preferably from 1 to 10 mg/100 $cm^2$.

The phenolic cyan coupler of the present invention may be used as the cyan color image forming coupler in the red-sensitive emulsion layer and in a single compound, and may also be used in combination of two or more different compounds having substituted and unsubstituted acylamino groups in the second and fifth positions thereof.

Further, different cyan couplers other than the present invention may also be used in combination with the cyan coupler of the present invention within the limit not to harm the effect of the present invention.

The use of the phenolic cyan coupler of the present invention raises no leuco-dye formation problem, so that the use enables to harden the gelatin layer enough to withstand the processing in the alkaline bath. This matter is far beyond the expectation from the conventional art.

The aromatic primary amine color developing agent to be incorporated into the silver halide color photographic light-sensitive material of the present invention includes amino-phenolic or p-phenylenediamine derivative, which may be in the free form or in the form of hydrochloride, sulfate, and organic acid salt such as p-toluene sulfonate, tetraphenyl boronate, p-(t-octyl) benzenesulfonate and the like to be added to the silver halide color photographic light-sensitive material. Typical examples of such aromatic primary amine color developing agents are o-aminophenol, p-aminophenol, 5-amino-2-oxy-toluene, 2-amino-3-oxy-toluene, 2-oxy-3-amino-1,4-dimethyl-benzene, N,N-diethyl-p-phenylenediamine hydrochloride, N-methyl-p-phenylenediamine hydrochloride, N,N-dimethyl-p-phenylenediamine hydrochloride, N-ethyl-N-β-methanesulfoneamideethyl-3-methyl-4-amino-aniline and the sulfate thereof, N-ethyl-N-β-hydroxyethylamino-aniline, N,N-diethyl-3-(β-methane-sulfoneamideethyl)-4-aminoaniline hydrochloride, 4-amino-N-(2-methoxyethyl)-N-ethyl-3-methylaniline-p-toluenesulfone hydrochloride, N-ethyl-N-β-methanesulfoneamide ethyl-3-methyl-4-aminoaniline-tetraphenyl boronate, 4-amino-N-(2-methoxy ethyl)-N-ethyl-3-methyl aniline-tetraphenyl boronate, p-morpholinoaniline, p-pyperidinoaniline, 4-amino-N,N-diethyl-3-fluoroaniline, and the like.

The aromatic primary amine color developing agent precursor to be comprised in the silver halide color photographic light-sensitive material include such Shiff base type precursor with aromatic aldehyde derivatives as described in U.S. Pat. No. 3,342,599, No. 2,507,114 and No. 2,695,234, and Research Disclosure No. 15159, multivalent metal ion complex precursors of such metals as zinc, lead, cadmium and the like as described in U.S. Pat. No. 3,719,492, such phthalimide derivative precursor as described in British Pat. No. 803,783, such phosphoric acid imide derivative precursor as described in Research Disclosure No. 12146, such sugar amine reaction product precursor as described in Research Disclosure No. 13924, such urethane type precursor as described in Japanese Patent O.P.I. Publication No. 135628/1978, No. 79035/1979, and the like. More particularly, the following compounds may be enumerated:

Exemplified Precursors:

(1)

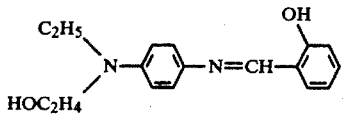

(2)

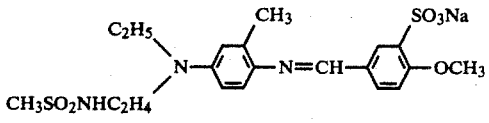

(3)

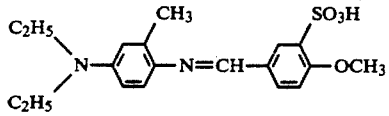

(4)

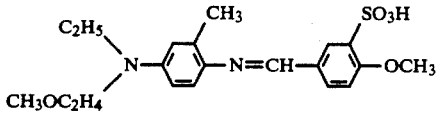

(5)

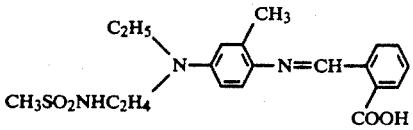

(6)

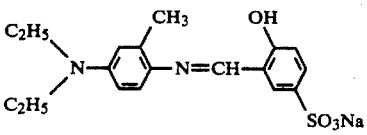

(7)

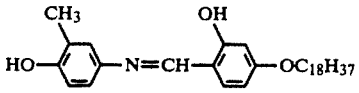

(8)

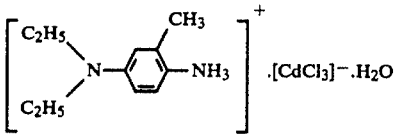

(9)

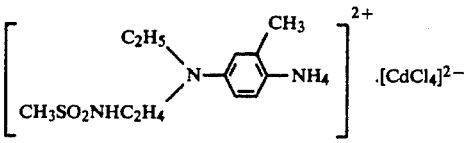

-continued

Exemplified Precursors:

(10)

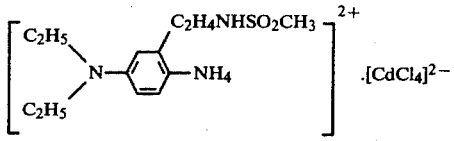

(11)

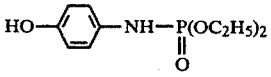

(12)

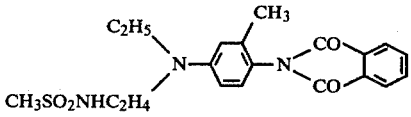

(13)

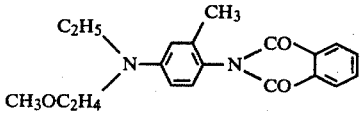

(14)

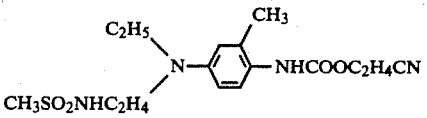

(15)

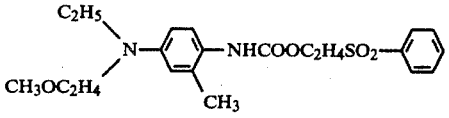

These aromatic primary amine color developing agent or the precursor thereof is needed to be incorporated in the silver halide color photographic light-sensitive material in such a quantity as enough to effect a sufficient color development with the quantity alone. The quantity varies according to the use of the silver halide color photographic light-sensitive material, but should be within the range of from approximately 0.5 mole to 3 moles per mole of the light-sensitive silver halide.

These aromatic primary amine color developing agents or the precursor thereof may be used singly or in combination, and in the case of adding to the silver halide color photographic light-sensitive material, may be dissolved in an appropriate solvent such as water, methanol, ethanol, acetone, dimethyl formamide and the like before the addition, and also may be added in the form of an emulsified dispersion liquid with such a high boiling organic solvent as dibutyl phthalate, dioctyl phthalate, tricresyl phosphate, and further, may also be added in the form of being impregnated into a latex polymer in such a manner as described in Research Disclosure No. 14850.

To the silver halide color photographic light-sensitive material is allowed to be added such a cyclic $\beta$-dicarbonyl compound as described in Japanese Patent O.P.I. Publication No. 111729/1978 for the purpose of preventing the desensitization, formation of stain, and deterioration of color densities of the material during the storage thereof.

Further, it is preferred that the silver halide color photographic light-sensitive material comprises a 1-aryly-3-pyrazolidone derivative for the acceleration of color development. Examples of the 1-aryl-3-pyrazolidone derivative includes the following compounds:

AP-1 1-phenyl-3-pyrazolidone
AP-2 1-tolyl-3-pyrazolidone
AP-3 4,4-dimethyl-1-phenyl-3-pyrazolidone
AP-4 4-methyl-4-hydroxy methyl-1-phenyl-3-pyrazolidone
AP-5 4-methyl-4-hydroxy methyl-1-tolyl-3-pyrazolidone
AP-6 4-methyl-4-acetoxy methyl-1-phenyl-3-pyrazolidone
AP-7 4-methyl-4-benzoyloxy methyl-1-phenyl-3-pyrazolidone Regarding nondiffusing couplers applicable to the silver halide color photographic light-sensitive material of the present invention, aside from the cyan coupler of the present invention, as a yellow coupler there may be used an open-chain $\beta$-ketomethylene compound and the like; as a magenta coupler there may be used a pyrazolone compound, a indazolone compound, a pyrazotriazole compound, a pyrazolinobenzimidazole compound and the like.

As light-sensitive silver halide emulsion applicable to the silver halide color photographic light-sensitive material of the present invention there may be used as light-sensitive elements all kinds of silver halides such as silver chloride, silver iodide, silver bromide, silver iodobromide, silver chlorobromide, silver chloroiodobromide, silver chloroiodide and the like, but the most preferred silver halide emulsions are the emulsions of silver chloride, silver chlorobromide, silver chloroiodobromide and silver chloroiodide which are excellent in the developability. These silver halide emulsions may be subjected to noble-metal sensitization by the use of such noble metals as ruthenium, rhodium, palladium, iridium, platinum, gold and the like; sulfur sensitization by sulphur compounds; selenium sensitization by selenium compounds; reduction sensitization by the use of stannous salts, polyamine salts and the like.

These emulsions may also be subjected to optical sensitization by the use of cyanine dye, merocyanine dye and the like, and further, to these emulsions may be added a such stabilizer as triazole compound, azaindene compound, benzthiazolium compound, zinc compound and other various known photographic additives.

The binder which forms the component layers of the silver halide color photographic light-sensitive material of the present invention is preferred to be gelatin, but besides gelatin, there may be used such derivative gelatins as phthalated gelatin, phenylcarbamoyl gelatin, albumin, agar-agar, gum arabic, alginic acid, casein, partially hydrolyzed cellulose derivatives, and further, partially hydrolyzed polyvinyl acetate, polyacrylamide, polyvinyl pyrolidone, and copolymers of these vinyl compounds may also be partially used. For hardening the binder comprised principally of gelatin there may be used known hardeners for use in the hardening of the gelatin layers of ordinary silver halide color photographic light-sensitive materials; for example, such organic hardening agents as epoxy hardening agents, ethyleneimino hardening agents, active vinyl hardening agents, N-methylol hardening agents, carbodiimide hardening agents, halogen-substituted-S-triazine hardening agents and the like, or such inorganic hardening agents as aluminium salts, chromium salts, zirconium salts and the like. The hardening degree of the gelatin layers of the silver halide color photographic light-sensitive material of the present invention by these hardening agents is required to be controlled so that, when the photographic light-sensitive material is immersed for a period of 60 seconds in an alkaline bath that is to be used as the processing bath therefor, the swelling degree is less than 300, preferably less than 250, the swelling degree being sought in accordance with the following definition:

$$S_W(\text{swelling degree}) = 100 \times (H_W - H_D)/H_D$$

wherein $H_W(\mu)$ represents the thickness of the wet gelatin layer and $H_D(\mu)$ represents the thickness of the gelatin layer after being dried. If the swelling degree, $S_W$, exceeds 300, gelatin becomes lacking in the mechanical strength required for the gelatin layer, causing such troubles that the layer gets scratched or, when transported by rollers through the alkaline bath of an automatic processor, gets peeled off and attached onto the rollers. If $S_W$ is maintained below 300, preferably below 250, such troubles hardly occurs. The facts have been confirmed through our repeated experiments.

As the support usable for the silver halide color photographic light-sensitive material of the present invention there may be used such transparent supports as, e.g., nitrocellulose film, acetyl cellulose film, polyvinyl acetal film, polycarbonate film, polystyrene film, polyethylene terephthalate film and the like, and synthetic reflection supports produced by filling such a white pigment as titanium dioxide into these transparent films, paper, and polymer-coated papers such as papers coated with polyethylene, polypropylene, The alkaline bath for use in the present invention is basically an alkaline solution not comprising an aromatic primary amine color developing agent, but the bath may possibly comprise the aromatic primary amine color developing agent that is dissolved thereinto from the photographic light-sensitive material being processed in the bath. The concentration of the color developing agent dissolved into the bath varies according to the quantity of the color developing agent comprised in the photographic light-sensitive material, the contents of the alkaline bath, the replenishing quantity of the alkaline bath, the rate of dissolving from the light-sensitive material into the bath, and the like, but it is desired that the pH and temperature of the alkaline bath or the quantity of a development restrainer to be added be controlled to the extent that the developing reaction going on in the alkaline bath is not substantially affected by the amount of the color developing agent dissolving into the bath.

The alkaline bath of the present invention includes the solution comprising such an alkaline agent as potassium hydroxide, sodium hydroxide, sodium carbonate, potassium carbonate, sodium tertiary phosphate, potassium tertiary phosphate; such a sulfite as sodium sulfite, potassium sulfite, and the like; such a bromide as sodium bromide, potassium bromide, ammonium bromide, and the like. Further, to the alkaline bath there may be applied at need an organic development restrainer; a thiocyanate such as sodium thiocyanate, potassium thiocyanate, ammonium thiocyanate; a chloride as ammonium chloride, potassium chloride, sodium cholide; an organic solvent such as ethylene glycol, diethylene glycol, methanol, ethanol, n-butanol, benzyl alcohol, acetone, dimethyl formamide; such an amine as hydroxyamine, ethanolamine, ethylenediamine, diethanolamine; such a water softener as sodium hexametaphosphate, sodium tripolyphosphate, ethylenediamine tetraacetic acid, diethylenetriamine pentacetic acid.

To the alkaline bath of the present invention may also be added as an auxiliary developing agent a phenidone derivative in the quantity of from 1 to 500 mg, preferably from 10 to 200 mg per liter of the bath. Such phenidone derivatives may be typified by the hereinbefore cited exemplified compounds (AP-1) through (AP-7).

The alkaline bath of the present invention should be so sufficiently activated that the aromatic primary amine developing agent from the silver halide color photographic light-sensitive material is not substantially dissolved into the bath before the formation of an image. The pH of the bath should be from 10.5 to 13.5, preferably from 11.0 to 13.0, while the temperature should be from 20° to 70° C., preferably from 35° to 60° C.

The bleach-fixing bath for the present invention is comprised basically of a bleaching agent and a fixing agent. As the bleaching agent applicable to the bleach-fixing bath of the present invention, there may be employed compound that are used in ordinary color photographic bleach-fixing bath, for example, such ferric aminopolycarboxylate as ethylenediamine ferric tetraacetate, ammonium ethylenediamine ferric tetraacetate, and the like; such persulfates as ammonium persulfate, sodium persulfate, and the like. As the fixing agent applicable to the bleach-fixing bath of the present invention there may be employed compound that are used in ordinary color photographic bleach-fixing bath, for example, such thiosulfate as sodium thiosulfate, ammonium thiosulfate; such water-soluble sulfur-containing diol as 3,6-dithia-1,8-octanediol, 3,6,9,12-tetrathia-1,14-tetradecanediol, and the like; such water-soluble sulphur comprising dibasic acid as ethylene-bis-thioglycolic acid, sodium ethylene-bis-thioglycolate, 3,6,9-trithiahendecanedioic acid, and the like.

To the bleach-fixing bath of the present invention may be added at need such compounds described in Japanese Patent Examined Publication No. 38895/1979 as carbonyl hydrogensulfite adducts, alkali metal hydrogensulfites, water-soluble thiocyanates, alkali metal bromides or iodides, ammonium bromide, non-chelate salts of aminopolycarboxylic acids, and the like, and further to the bleach-fixing bath may also be added known bleach accelerating agents. The pH of the bleach-fixing bath should be from about 4 to about 8, preferably from about 5 to about 7.

The imagewise exposed silver halide color photographic light-sensitive material comprising an aromatic primary amine color developing agent or the precursor thereof of the present invention, upon color developing in the alkaline bath, is permitted to be processed in the bleaching bath or particularly in the bleach-fixing bath, but an acid stopping bath may be used between the alkaline bath and the bleaching bath or the bleach-fixing bath. As such an acid stopping bath there may be used an aqueous solution of acetic acid, citric acid, and the like.

The present invention is illustrated in further detail with reference to examples below, but the present invention is not limited thereto.

EXAMPLE 1

A polyethylene-coated paper was coated thereon with six kinds of coating composition to prepare four different samples (Sample No. 1. to Sample No. 4) (various compounds to be added to the silver halide color photographic light-sensitive material are hereinafter indicated in the quantity per 100 $cm^2$ unless otherwise stated).

The First Layer

A blue-sensitive emulsion coating liquid comprising a blue-sensitive silver chlorobromide emulsion having the mean particle diameter of 0.75μ (Br: 60 mol%, silver coating quantity: 4.5 mg/100 $cm^2$); 4 mg of di-n-butyl phthalate coupler solvent into which are dissolved 8 mg of 2-(1-benzyl-2,4-dioxy-imidazolidine-3-yl)-2-pyvaryl-2'-chloro-5'-[4-(2,4-di-tertiaryamylphenoxy)-butaneamide]acetanilide, 0.5 mg of 5,5-dimethylcyclohexanedione, and 0.1 mg of 2,5-di-tert-octyl hydroquinone; 12.5 mg of exemplified precursor-2; and 14.7 mg of gelatin.

The Second Layer

The first interlayer coating liquid comprising 0.3 mg of di-n-butyl phthalate solvent into which is dissolved 0.5 mg of 2,5-di-tert-octyl hydroquinone; 0.65 mg of 4-methyl-4-hydroxymethyl-1-phenyl-3-pyrazolidone; and 10.3 mg of gelatin.

The Third Layer

A green-sensitive emulsion coating liquid comprising a green-sensitive silver chlorobromide emulsion having the mean particle diameter of 0.49μ (Br: 65 mol%, silver coating quantity: 4.0 mg); 3.4 mg of tricresyl phosphate solvent into which are dissolved 6.3 mg of 3-[2-chloro-5-(1-octadecyl succineimide) anilino]-1-(2,4,6-trichlorophenyl)-5-pyrazolone, 0.5 mg of 5,5-dimethyl cyclohexanedione and 0.15 mg of 2,5-di-tert-octyl hydroquinone; 10.0 mg of exemplified precursor-2; and 18.5 mg of gelatin.

The Fourth Layer

The second interlayer coating liquid comprising 0.3 mg of di-n-butyl phthalate solvent into which is dissolved 0.5 mg of 2,5-di-tert-octyl hydroquinone; 0.3 mg of 4-methyl-4-hydroxymethyl-1-phenyl-3-pyrazolidone; and 14.5 mg of gelatin.

The Fifth Layer

A red-sensitive emulsion coating liquid comprising a red-sensitive silver chlorobromide emulsion having the mean particle diameter of 0.40μ (Br: 75 mol%, silver coating quantity: X mg*), 4.3 mg of di-n-butyl phthalate solvent into which are dissolved Y mg* of a cyan coupler and 0.05 mg of 2,5-di-tert-octyl hydroquinone; 8.5 mg of exemplified precursor-2; and 16 mg of gelatin.

The Sixth Layer

A protective layer coating liquid comprising 0.01 mg of liquid paraffin, 0.4 mg of 4-methyl-4-hydroxymethyl-1-phenyl-3-pyrazolidone, and 18 mg of gelatin.

In the fifth layer, the kind and quantity of the cyan coupler and the coating quantity of silver indicated with the mark * are as shown in Table 1.

TABLE 1

| Sample No. | Cyan coupler* Coating quantity | Xmg* | Silver Coating quantity Ymg* |
|---|---|---|---|
| 1, 2 | Control coupler-1 | 4.2 | 3.0 |
| 3 | Exemplified coupler-7 | 5.9 | 3.0 |
| 4 | Exemplified coupler-5 | 4.1 | 5.8 |

In addition, to the respective layers of each of Samples No. 1 to No. 4 was added bis-vinyl sulfonyl methyl-ether (H-1) as a hardener in such quantities as shown in Table 2 immediately before their coatings. And to the blue-sensitive, green-sensitive and red-sensitive emulsion layers each were added 6-hydroxy-4-methyl-tetrazaindene as a stabilizer in the quantity of 2 grams per mol of silver.

Control Coupler-1

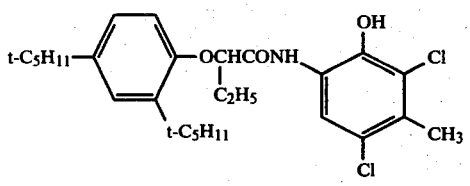

TABLE 2

| Sample No. | 1st layer | 2nd layer | 3rd layer | 4th layer | 5th layer | 6th layer |
|---|---|---|---|---|---|---|
| 2, 3, 4 | — | 0.29 | 0.47 | 0.39 | 0.52 | 0.60 |
| 1 | — | 0.17 | 0.28 | 0.23 | 0.31 | 0.38 |

The resulting four samples were allowed to stand over a period of seven days under the atmospheric condition of the temperature of 28° C. with relative humidity of 50%, and then were immersed for 60 seconds in each of the color developing solution, alkaline solution, bleach-fixing solution A and bleach-fixing solution B, having the following compositions respectively, at 33° C. (except 45° C. in the alkaline bath) to make measurements on the thickness of swelled layers of the samples, thus finding swelling degrees of them the results of which are shown in Table 3.

| | |
|---|---|
| Color developing solution: | |
| Pure water | 800 ml |
| Ethylene glycol | 15 ml |
| Benzyl alcohol | 15 ml |
| Hydroxylamine sulfate | 2.0 g |
| Anhydrous potassium carbonate | 30.0 g |
| Potassium bromide | 0.5 g |
| Sodium chloride | 1.5 g |
| Anhydrous potassium sulfite | 2.0 g |
| N—ethyl-N—β-methanesulfoneamide ethyl-3-methyl-4-aminoaniline sulfate | 4.5 g |
| Water to make 1 liter, whose pH is controlled by the use of potassium hydroxide or sulfuric acid. | 10.2 |
| Alkaline solution: | |
| Pure water | 800 ml |
| Ethylene glycol | 15 ml |
| Benzyl alcohol | 15 ml |
| Hydroxylamine sulfate | 2.0 g |
| Anhydrous potassium carbonate | 35.0 g |
| Potassium bromide | 0.1 g |
| Anhydrous potassium sulfite | 2.0 g |
| Water to make 1 liter, whose pH is controlled with potassium hydroxide or sulfuric acid. | 11.8 |
| Bleach-fixing solution A: | |
| Ferric sodium ethylenediamine-tetraacetate | 50 g |
| Ammonium thiosulfate | 85 g |
| Sodium bisulfite | 10 g |
| Sodium metabisulfite | 2 g |
| Disodium ethylenediaminetetraacetate | 20 g |
| Sodium bromide | 5.0 g |
| Water to make 1 liter, whose pH is controlled with aqueous ammonia or sulfuric acid. | 7.0 |

Bleach-fixing solution B

To 500 ml of Bleach-fixing solution A are added 400 ml of the alkaline solution, 20 ml of 5% aqueous silver nitrate solution and 20 g of anhydrous sodium sulfate, and then pure water to make 1 liter, whose pH is controlled 6.9, and further whose oxidation-reduction potential is controlled −100 mV (electrode: silver-silver chloride electrode) by the use of steel wool or by air bubbling. In addition, the resulting solution B is what is prepared modelling an exhausted bleach-fixing solution on the assumption of having processed a large number of silver halide color photographic light-sensitive materials.

TABLE 3

| | (swelling degrees) | | | |
|---|---|---|---|---|
| Sample No. | Color developing solution | Alkaline solution | Bleach-fixing solution A | Bleach-fixing solution B |
| 1 | 195 | 330 | 105 | 100 |
| 2 | 120 | 170 | 70 | 70 |
| 3 | 125 | 185 | 70 | 70 |
| 4 | 120 | 180 | 70 | 70 |

Three groups of the above four samples were prepared and exposed through an optical wedge to light, and thereafter were subjected to the following three kinds of processings:

Processings I:
- Color developing for 3 min. 30 sec. at 33° C.
- Bleach-fixing (in solution B) for 1 min. 30 sec. at 33° C.
- Washing for 3 min.
- Drying Processings II:
- Activator processing for 1 min. at 45° C.
- Bleach-fixing (in solution A) for 1 min. 30 sec. at 33° C.
- Washing for 3 min.
- Drying Processings III:
- Activator processing for 1 min. at 45° C.
- Bleach-fixing (in solution B) for 1 min. 30 sec. at 33° C.
- Washing for 3 min.
- Drying Measurements were made on the red transmission densities in the maximum region of the resulting samples, thereby obtaining the results as shown in Table 4, in which the values of the red transmission densities are the values obtained after subtracting the red transmission density of the polyethylene-coated paper alone from the red transmission densities of the dye images color-developed on the polyethylene-coated paper.

TABLE 4

| Sample No. | Processings I | Processings II | Processings III |
|---|---|---|---|
| 1 | 2.25 | 2.18 | 1.90 |
| 2 | 2.03 | 2.00 | 0.90 |
| 3 | 2.34 | 2.32 | 2.33 |
| 4 | 2.19 | 2.19 | 2.16 |

As seen from Table 3, the respective layer strengths correspond to the used quantities of the hardener indicated in Table 2. In the present example, Sample No. 1, although showing the optimum layer strength in the color development, shows as much high a swelling degree as 330 in the alkaline bath, so that the sample is not deemed having a sufficient layer strength. On the other hand, regarding Samples 2, 3 and 4 all having sufficient layer strength in the alkaline bath, Sample No. 2 which uses Control Coupler-1 shows almost satisfactory color-developed image with little formation of a cyan leuco dye when processed in a fresh bleach-fixing solution A (Processings II), while when processed in bleach-fixing solution B modelling an exhausted bleach-fixing bath, a significant formation of a cyan leuco dye is observed, and the resulting cyan color developed image is with as much low a red transmission density as 0.90. In contrast to this, Samples No. 3 and No. 4 of the present invention show as much sufficient the formation of cyan dye as in the reference processings I despite of the outstanding increase in the layer strength in both bleach-fixing solutions A and B just as in the contrast of Sample No. 2 to Sample No. 1.

EXAMPLE 2

Five kinds of color photographic printing paper were prepared which have the same component layers and emulsion composition as in Example 1, provided that as hardening agents two different hardening agents [H-2] and [H-3] having the following formulas were added in the quantities (mg) shown in Table 5. The kinds and the adding quantities of cyan couplers used are shown in Table 6.

[H-2]

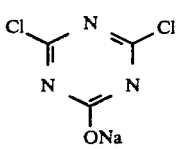

[H-3]

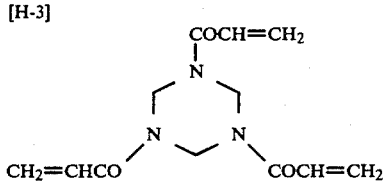

TABLE 5

| Sample No. | Hardener | 1st layer | 2nd layer | 3rd layer | 4th layer | 5th layer | 6th layer |
|---|---|---|---|---|---|---|---|
| 5 | H-2 | — | 0.19 | — | 0.25 | — | 0.25 |
| | H-3 | 0.19 | — | 0.25 | — | 0.25 | — |
| 6, 7 | H-2 | — | 0.38 | — | 0.50 | — | 0.50 |
| 8 and 9 | H-3 | 0.19 | — | 0.50 | — | 0.50 | — |

TABLE 6

| Sample No. | Cyan coupler in mg | | Red sensitive layer coating quantity of silver in mg |
|---|---|---|---|
| 5, 6 | Control coupler-2 | 3.9 | 3.0 |
| 7 | Exemplified coupler-17 | 5.8 | 5.8 |
| 8 | Exemplified coupler-27 | 5.3 | 5.8 |
| 9 | Exemplified coupler-29 | 3.9 | 3.9 |
| | Control coupler-2 | 1.3 | |

Control Coupler-2

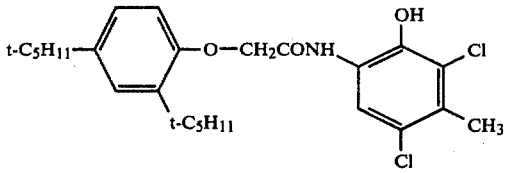

The samples were immersed for 60 seconds in each of the color developing solution, alkaline solution, bleach-fixing solutions A and B that were used in Example 1 thereby to make measurements on swelling degrees of the samples. The results are shown in Table 7.

| | |
|---|---|
| Color developing solution<br>Bleach-fixing solution A | at 33° C. |
| Alkaline solution<br>(Exhausted) Bleach-fixing solution B | at 50° C. |

TABLE 7

| Sample No. | Color developing solution at 33° C. | Bleach-fixing sol. A at 33° C. | Alkaline solution at 50° C. | Bleach-fixing sol. B at 50° C. |
|---|---|---|---|---|
| 5 | 180 | 110 | 480 | 165 |
| 6 | 115 | 60 | 200 | 110 |
| 7 | 115 | 65 | 210 | 110 |
| 8 | 120 | 65 | 210 | 115 |
| 9 | 125 | 65 | 215 | 115 |

As apparent from Table 7, control sample No. 5 shows a sufficiently secure layer strength in the color developing solution at 33° C., while in the alkaline solution at 50° C. it shows an outstandingly high swelling of the gelatin layer being as high as 480, so that the sample is not deemed having a sufficient layer strength, whereas Samples 6, 7, 8 and 9 of the present invention are found out to be satisfactory in the layer strength in the alkaline solution.

The five kinds of color printing paper, the samples from No. 5 to No. 9 were imagewise exposed and then treated in the following two rounds of processings:

Processings IV:
- Color developing for 3 min. 30 sec. at 33° C.
- Bleach-fixing (in solution A) for 1 min. 30 sec. at 33° C.
- Washing for 3 min.
- Drying Processings V:
- Alkaline processing for 30 sec. at 50° C.
- Stopping for 10 sec. at room temperature
- Bleach-fixing (in solution B) for 60 sec. at 50° C.
- Washing for 3 min.
- Drying Measurements were made on the red transmission densities in the maximum density region of the thus obtained samples in the same manner as in Example 1, thereby obtaining the results as shown in Table 8, in which the parenthesized values in Processing V are those which were obtained by measuring in a similar way the red transmission densities of samples that were produced in such a manner that the samples processed in Processings V were treated for 5 minutes at room temperature in a red prussiate bleaching solution comprising 3 g of red prussiate of potash and 2 g of potassium bromide per liter of the solution, and then washed and dried. The differences between these values and those before the red prussiate bleaching may be utilized as approximate criteria for the formation of cyan leuco dyes.

TABLE 8

| Sample No. | Processings IV | Processings V |
|---|---|---|
| 5 | 2.20 | 1.80 (2.19) |
| 6 | 2.16 | 0.72 (2.20) |
| 7 | 2.39 | 2.26 (2.33) |

TABLE 8-continued

| Sample No. | Processings IV | Processings V |
|---|---|---|
| 8 | 2.29 | 2.12 (2.23) |
| 9 | 2.23 | 2.00 (2.18) |

As apparent from Table 8, the results of Processings V of Samples 5 and 6, to which was applied Control coupler-2 show considerable formations of leuco dyes as compared to Processings IV, which represents an ordinary color developing; especially, Sample No. 6 which has a sufficient layer strength in the alkaline solution at 50° C. shows that its cyan color density goes down to about one third of the cyan color density up to which the sample is to be developed in itself in Processings V. In contrast to this, Samples 7, 8 and 9 are found out to give satisfactory cyan dye images with maintaining their layer strength sufficiently in the alkaline bath.

We claim:

1. A method for the formation of a dye image comprising the steps of:

color-developing in an alkaline bath a silver halide color photographic light-sensitive material comprising a support, component layers, said layers being provided on said support and having a swelling degree of less than 250 in said alkaline bath, and components comprising an aromatic primary amine color developing agent or a precursor thereof, a nondiffusing yellow coupler, a nondiffusing magenta coupler and a nondiffusing phenolic cyan coupler having a substituted or unsubstituted acylamino group at the second and fifth positions thereof; and processing said material in a bleach-fixing bath.

2. The method according to claim 1 wherein said cyan coupler has the following formula [I] or [II]:

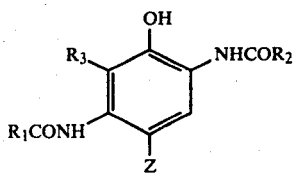

Formula [I]

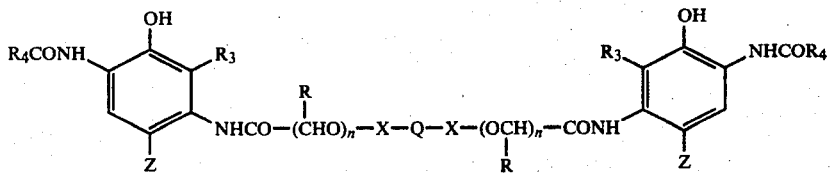

Formula [II]

Wherein (in both formulas [I] and [II]) R represents hydrogen or an alkyl group having from 1 to 20 carbon atoms, $R_1$ and $R_2$ independently represent a substituted or unsubstituted alkyl group, aryl group, heterocyclic group or $$-\underset{\underset{R'}{|}}{(CHO)_m}-X'-R^5,$$

$R_3$ represents hydrogen, chlorine or bromine, $R_4$ represents an alkyl group, aryl group or heterocyclic group, X represents an alkylene group or arylene group, Q represents $$-\underset{\underset{A}{|}}{N}-SO_2-(R'')_{m''}-(C'y)-(Y)l-(C'y)k-(R''')_{m'''}-SO_2-\underset{\underset{A}{|}}{N}-$$

or $$-SO_2-\underset{\underset{A}{|}}{N}-(R'')_{m''}-(C'y)-(Y)l-(C''y)k-(R''')_{m'''}-\underset{\underset{A}{|}}{N}-SO_2-,$$

Z represents hydrogen or a group capable of being split off on coupling reaction, and n is an integer of 0 or 1 and R' represents hydrogen or an alkyl group having from 1 to 20 carbon atoms, X' represents an alkylene group or arylene group, $R_5$ represents hydrogen, alkylsulfoneamide group, arylsulfoneamide group, alkylsulfamoyl gorup, arylsulfamoyl group, alkyloxycarbonyl group, alkyloxysulfonyl group, aryloxysulfonyl group, alkylsulfonyloxy group, arylsulfonyloxy group, $$-Cy-(R'')_{m'}-SO_2-\underset{\underset{A}{|}}{N}-,\ -Cy-(R'')_{m'}-\underset{\underset{A}{|}}{N}-SO_2-,$$

or either one of the monovalent group having at least one sulfone group, Cy, Cy' and Cy'' represent cyclic groups comprising an aliphatic cyclic group, aromatic cyclic group, or heterocyclic group, R'' and R''' each represent an alkyl group, Y represents a divalent organic group which connects C' y with C'' y, A represents hydrogen or a monovalent organic group, and k, l, m,m',m'' and m''' independently represent an integer of zero or 1 provided that when m'=0, the Cy represents an aliphatic cyclic or heterocyclic group.

3. The method according to the claim 2 wherein said alkyl groups represented by R and R' in Formulas [I] and [II] is of either straight chain or branched chain.

4. The method according to claim 2 wherein said alkyl groups represented by $R_1$, $R_2$ and $R_4$ independently represent an alkyl group having from 1 to 20 carbon atoms which is of either straight chain or branched chain.

5. The method according to the claim 2 wherein said X and X' independently represent an alkylene group having from 1 to 4 carbon atoms, or an arylene group.

6. The method according to claim 2 wherein said alkyl comprised in the alkylsulfoneamide, alkylsulfamoyl, alkyloxycarbonyl, alkyloxysulfonyl, alkylsulfonyl group in $R_5$ is either of straight chain or of branched chain having from 1 to 20 carbon atoms.

* * * * *